United States Patent [19]

Kimpel Rolf-Dieter

[11] Patent Number: 4,956,623

[45] Date of Patent: Sep. 11, 1990

[54] ELECTROMAGNETIC RELAY

[75] Inventor: Kimpel Rolf-Dieter, Berlin, Fed. Rep. of Germany

[73] Assignee: Siemens Aktiengesellschaft, Berlin and Munich, Fed. Rep. of Germany

[21] Appl. No.: 311,759

[22] Filed: Feb. 17, 1989

[30] Foreign Application Priority Data

Feb. 19, 1988 [DE] Fed. Rep. of Germany ..... 3805254

[51] Int. Cl.[5] ..... H01H 67/02

[52] U.S. Cl. ..... 335/128; 335/80; 335/275

[58] Field of Search ..... 335/78–85, 335/128, 275, 276

[56] References Cited

U.S. PATENT DOCUMENTS

| | | | |
|---|---|---|---|
| 4,682,133 | 7/1987 | Kern . | |
| 4,691,181 | 9/1987 | Katsutani et al. | 335/275 |
| 4,701,734 | 10/1987 | Nakano et al. | 335/275 |
| 4,745,382 | 5/1988 | Dittmann | 335/78 |

FOREIGN PATENT DOCUMENTS

| | | |
|---|---|---|
| 2614926 | 10/1977 | Fed. Rep. of Germany . |
| 3232679 | 3/1983 | Fed. Rep. of Germany . |
| 2517464 | 6/1983 | France . |

*Primary Examiner*—Leo P. Picard
*Assistant Examiner*—Donovan
*Attorney, Agent, or Firm*—Hill, Van Santen, Steadman & Simpson

[57] ABSTRACT

A relay having a coil including a core also has either one or two angled armatures. Each of two armatures has a second leg extending approximately parallel to the axis of the coil as well as an extension upon which a restoring spring acts. Each armature has a contact spring which is connected thereto. Due to the displacement of the bearing location the end of the second armature leg, increased friction at the contact locations arises as well as reduction in the welding tendency of the contacts. Reduction of the effective spring force of the restoring spring during armature attraction also arises due to the seating of the armature so that reliable operation is provided without increased electromagnetic excitation.

5 Claims, 4 Drawing Sheets

ELECTROMAGNETIC RELAY

BACKGROUND OF THE INVENTION

1. Field of the Invention

The present invention is directed generally to an electromagnetic relay, and more particularly to a relay including a coil, a core arranged axially in the coil, a first yoke formed as an armature having one leg forming a working air gap relative to the first end of the coil and the armature being coupled to a contact spring. The relay also includes a second yoke that is L-shaped, the second yoke having a first leg facing toward a second end of the core and having a second leg extending essentially parallel to the axis of the coil where the free end of the first yoke is seated in the region of a free end of the second leg of the second yoke. The relay also includes a tension restoring spring which acts on an extension of the first and second yoke and which extends essentially parallel to the axis of the coil.

2. Description of the Related Art

A relay structure of the type described above is shown, for example, in German Patent No. 32 32 679, although such relay structures are also known in many other embodiments. Relays of this type can be manufactured relatively simply and at a relatively low cost. They are rugged when subject to external influences and are, therefore, used in great numbers. One such use is in motor vehicles.

Relays of the known type having this traditional design each comprise a plate-shaped armature which is usually seated at the yoke in the region of an end edge. Although other embodiments are also known having an angled armature, the bearing location even in such angled armatures is normally situated roughly in extension of the pole surface. When high DC currents are switched with such relays, there is a great amount of material which migrates from the contacts and there is also a relatively great tendency for the contacts to weld. These undesired effects are especially pronounced when the melted contact material, which is a result of the arc across the contacts can solidify at the same location as the arc, such as when there is no relative motion at the contact locations. This is frequently the case with relays of the type described above since the contact springs are usually directly connected to the armature.

A further disadvantage of the traditional relay arrangement is that the force exerted on the armature by the restoring spring may also have to generate the quiescent contact force which opposes the excitation force. Such opposing forces are present even when the armature is being attracted in these traditional systems. Care must, therefore, be exercised to see that the magnet system, which includes the coil, is designed so that the force generated by the excitation system at every point in time of the response is greater than the opposing forces exerted by the restoring spring and potentially also by the contact springs. When the difference between the force curves of these two opposing forces is excessively low, there is a risk that the relay will not entirely pull through or will not pull through quickly enough to provide reliable electrical contact, particularly given unfavorable tolerance conditions.

SUMMARY OF THE INVENTION

It is therefore an object of the invention to produce friction between the contact surfaces of a relay by improving the structural design in a relay system. At the same time, the relay of the present invention increases the distance between the force-path characteristic of the magnet system, on the one hand, and the spring forces opposing the magnet system, on the other hand, given predetermined contact forces and without increasing the excitation power required for the relay. The invention, thus, improves the attraction reliability of the relay and reduces the chance of contact welding. The magnet system forces and the spring forces mentioned above in this context are, of course, forces opposing one another, taking into consideration the respective lever actions or torques of the relay.

These and other objects of the invention are achieved by providing a first yoke of the relay as the relay armature where the armature has an L-shape, forming the working air gap of the relay with the first leg of the L-shaped armature, and arranging the second leg of the armature so that it extends approximately parallel to the coil axis and has its free end seated next to the coil at the free end of a second yoke. The armature also comprises an extension of its first leg extending beyond the angled second leg, the extension being the point at which the restoring spring acts.

The desired improvement of the force-path characteristic of the spring forces in the present invention is the result of the armature not only being angled but also having its bearing location at the end of the angled second leg. In other words, the bearing, or pivot, location is roughly in the middle region of the coil length. As a result thereof, the armature does not pivot during the switching motion about a point on the bend connecting the two legs, but instead pivots about a point at the free end of the second leg which, depending upon the length of the second leg, has a greater distance from the plane of the pole surface of the coil core. This causes the contact spring connected to the first armature leg to undergo a movement path at the contact location which includes a relatively great friction component so that the material migration and the welding tendency of the contacts are both avoided, or at least reduced.

A significant, further advantage of the invention also lies in that the restoring spring which acts at the extension of the armature, as well as at an extension of the second yoke, provides a decreasing characteristic of its effective spring power during the armature attraction motion. This can be explained in that the point of attack of the restoring spring relative to the bearing location also moves significantly because of the rotational movement of the angled armature around the far end of the second armature leg. Thus, the effective lever arm for the force of the restoring spring is significantly reduced when the armature attracts. Although the spring force of the restoring spring remains about the same or even increases slightly during the armature motion, the spring force multiplied by the lever arm results in a lower torque which opposes the torque exerted by the magnet system.

In an especially advantageous development of the relay, the second yoke is also formed as an angled, or L-shaped, armature which has a first leg forming a working air gap together with a second core end and has its angled second leg seated next to the yoke. In this development, the relay thus has two movable armatures without requiring separate, immobile flex return elements. In other words, no additional yoke pieces are required. The advantages of contact friction and of the improved force-path characteristic are also established in the second armature arrangement in this dual armature relay. Over and above this, a dual armature relay has many known advantages, such as increased reliability against welding, when the two contact arrangements are in series connection.

Additional improvements and developments of the invention include immobilizing the second yoke and providing a first leg of the second yoke connected to the core. Alternately, the second yoke can form a second armature which has its first leg defining a working air gap relative to the core and in which the free ends of the second legs of both yokes are seated movable relative to one another.

In one development, the second legs of the first and second yokes extend over approximately half of the coil length and applied, inter-engaging bearing elements are provided for both armatures. Alternately, both armatures may include a common bearing element on which they are seated. The bearing or supporting elements for the armatures may be mounted to the housing in the region of the bearing ends of the armatures. An improvement relating to the restoring spring includes a section of the restoring spring forming an extension of the armatures upon which the restoring spring attacks.

DESCRIPTION OF THE PREFERRED EMBODIMENTS

Figure 1:
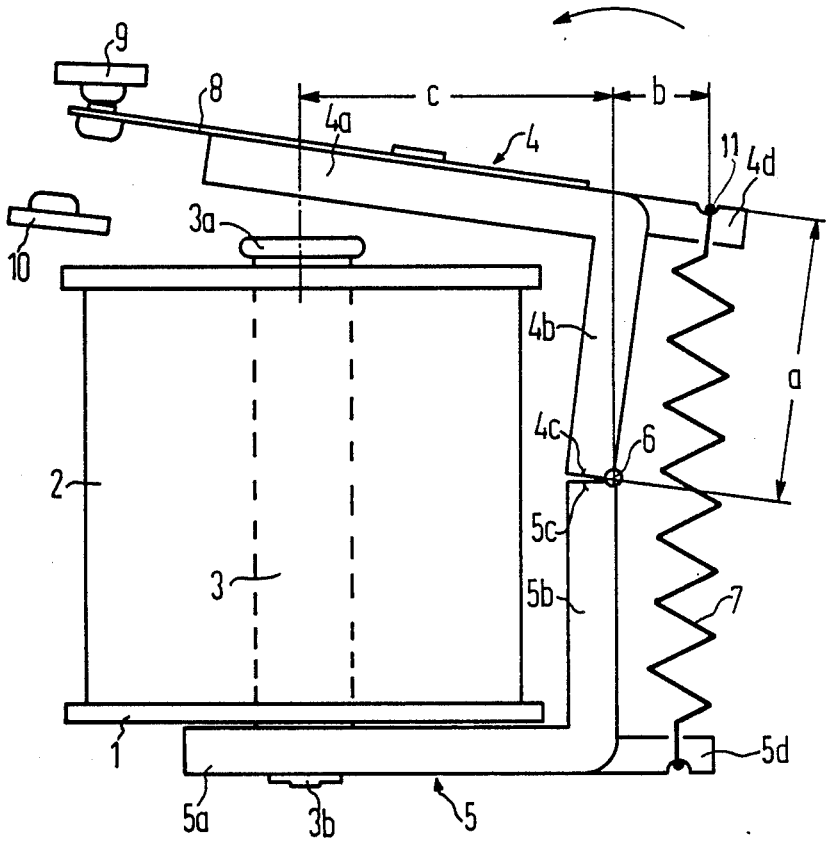
FIG. 1 is a diagrammatic side elevational view of a relay system having a stationery yoke and a movable, angled armature according to the principles of the present invention.

FIG. 1 shows diagrammatically the basic structure of a relay of the present invention. The illustrated relay includes a coil having a coil member 1 and a winding 2. Arranged inside the coil member 1 in an axial direction is a core 3 which has a first core end 3*a* that defines a working air gap with a movable yoke or armature 4. A second, opposite end 3*b* of the core 3 is connected to a stationary yoke 5. The stationary yoke 5 has a first yoke leg 5*a* that lies perpendicular to the coil axis. A second leg 5*b* of the yoke 5 is bent, preferably at a right angle, relative to the first leg 5*a* into a direction extending parallel to the axis of the coil, and extending in length up to approximately the middle of the coil length.

The armature 4, also referred to as a movable yoke, is also formed in an angular or L shape so that a first armature leg 4*a* forms the working air gap with the core end 3*a* and a second armature leg 4*b* is roughly parallel to the coil axis. A free end 4*c* of the second leg 46 of the movable yoke or armature 4 is seated on a free end of the second yoke leg 5*b*. A bearing point or pivot point between the free ends 4*c* and 5*c* about which the armature 4 pivots is referenced 6 in FIG. 1.

The movable armature 4 has an extension 4*d* which is an extension of the first armature leg 4*a* extending beyond the angled or bent portion. Correspondingly, the yoke 5 has an extension 5*d* as an extension of the first yoke leg 5*a* which extends beyond the angled or bent portion of the second yoke leg 5*b*. A restoring spring 7 is hooked between the two extensions 4*d* and 5*d*, the restoring spring 7 being stressed in tension and preferably being formed as a coil spring. The spring acts, or attacks, at a point 11 on the extension 4*d*.

The present relay also includes a contact spring 8 secured to the armature 4 to form a normally closed contact with a second cooperating contact 9 and a normally open contact with a cooperating contact 10. The two cooperating contact elements 9 and 10 are merely shown schematically in FIG. 1.

The relay as illustrated in FIG. 1 is shown in a switch position in which the relay is in a non-excited or quiescent condition wherein the contact spring 8 presses its contact element against the cooperating contact element 9. The contact pressure therebetween is provided by the restoring spring 7. When the coil 2 is excited, the armature 4 is attracted toward the first end 3*a* of the core 3 and thereby traverses the working air gap. The armature 4 pivots about the pivot point 6 to bring the contact element on the contact spring 8 into contact with the cooperating contact element 10. Due to a distance a as indicated in FIG. 1, which is the length of the armature leg 4*b* on the pivot point 6, the contact spring 8 undergoes a noteworthy motion component in the longitudinal direction which results in a considerable friction component being generated on the respective contact surfaces. As a result of this longitudinal motion component, both the material migration of the contact element material as well the mechanical contact wear are kept low.

Also occurring during the switch motion is a reduction in a distance b between the pivot point 6 and the point of attack 11 of the restoring spring 7 on the armature 4 as the armature leg 4*a* approaches the core end 3*a*. The reduction in the distance b results in an increasingly diminished spring force for the restoring spring 7. In other words, the product of the spring force of the restoring spring 7 and the lever arm length b becomes smaller while the force exerted on the armature 4 by the magnet system increases given an essentially unaltered lever arm length c.

Figure 2:
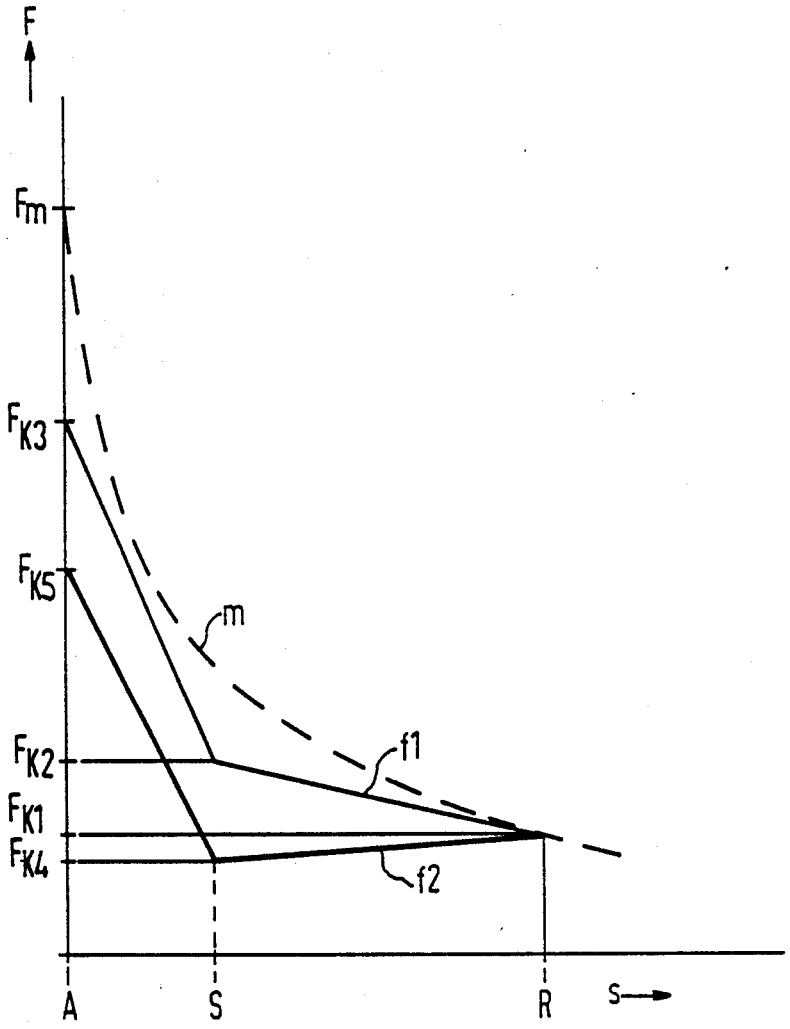
FIG. 2 is a graph showing the force path curves of a magnet system and of a contact set of a traditional relay in comparison to the force path curves of the relay of the present invention.

FIG. 2 shows a graph illustrating the force relationships for an exemplary embodiment of the present relay system compared to a known relay. On the abscissa of the graph is shown the path of motion s which the armature undergoes between a quiescent or resting position R (as shown in FIG. 1) and a working or closed position A (wherein the armature 4 is completely attracted against the end 3*a* of the core 3). The ordinate corresponds to the forces F exerted upon the armature 4. All forces on the graph in FIG. 2 are referenced to armature lever arms having the same length to make them comparable. A first curve m indicates the course of the forces generated by the magnet system during the excitation of the coil 2. The magnet force curve m increases as the armature 4 approaches the core 3 until it reaches a final value $F_m$ in a closed condition.

The second curve $f_1$ illustrates the course of the spring forces in a traditional relay of a comparable size and structure. The spring forces illustrated are those of the contact spring and the restoring spring. Upon actuation of the known relay, the armature must overcome a normally closed contact force $F_{K1}$ at the quiescent or resting point R until the contact opens. Thereafter, only the force of the restoring spring opposes the attractive forces of the magnet system. In the known system, as shown in curve f1, the force of the restoring spring increases as the armature moves toward the end of the core end until the contacts close at a point S. At this point, the force of the restoring spring reaches a level $F_{K2}$ which is greater than the force at the quiescent point $F_{K1}$. From then on, the contact spring lies against the cooperating contact element with a contact force. This contact force opposes the attracting force of the magnet system and is in addition to the restoring force which also still increases. In a final condition of the attracted armature in the known relay, the spring force reaches a final value $F_{K3}$.

As may be seen by reference to FIG. 2, the spring force curve f1 approaches rather close to curve m of the force of the magnet system at some locations. However, the spring force curve f1 dare not intersect or cross over the magnet system curve m since otherwise the spring force would be greater than the force of the magnet system and the armature would no longer be attracted.

Also shown in FIG. 2 is a curve f2 which is the force path curve obtained from a relay of the present invention, for example, as shown in FIG. 1. The curve f2 lies at a considerably further distance from the magnet force curve m and thereby yields greater energy reserves of the magnet system without altering the magnet system and also provides a more reliable relay response. In particular, upon movement of the armature 4 from the quiescent or resting position R with the opening of the normally closed contact in 9, curve f2 initially does not increase from the $F_{K1}$. This is true because the effective force of the restoring spring 7 decreases due to the reducing length of the lever arm b. This is illustrated in the graph of FIG. 2 by the forces of the resting point R to the switch point S being reduced from a force $F_{K1}$ to a lower force $F_{K4}$. The spring force curve f2 does not rise again until switch closing point S since the desired contact force is now built up at the normally open contact 10 by the action of the contact spring 8. The force curve f2 reaches a force amplitude $F_{K5}$ when the armature 4 reaches its final closed point A. Due to the significantly lower starting point from the switch point S, however, force curve f2 remains relatively far away from the magnet system curve m so that, thus, the desired reliability is guaranteed.

Figure 3:
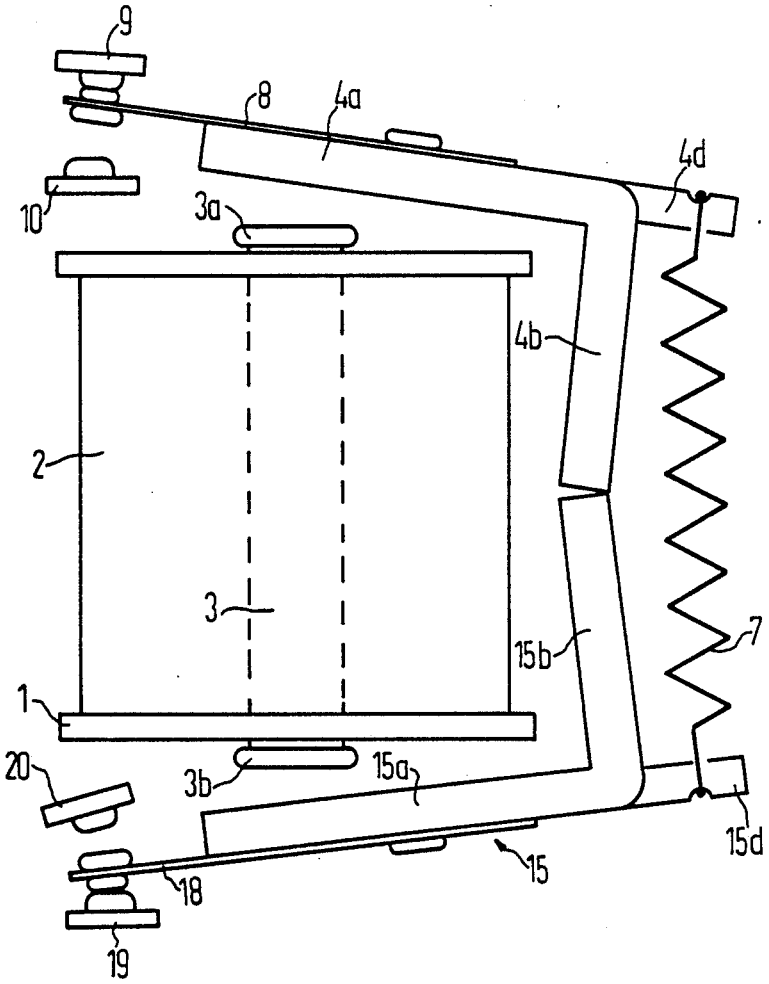
FIG. 3 is a diagrammatic side elevational view of a relay system of the invention including two armatures.

Referring now to FIG. 3, a schematic view of a second exemplary embodiment of a relay is shown. The coil member 1, winding 2, core 3 and armature 4 are constructed in substantially the same way and provided with identical reference numerals as in the embodiment shown in FIG. 1. Instead of the stationary yoke 5, however, a second movable yoke or second armature 15 is provided. The armature 15 defines a further working air gap with the second end of the core 3*b*. The second armature 15 is constructed quite similar to that of the first armature 4. In particular, the armature 15 includes a first armature leg 15*a*, an angled second armature leg 15*b*, and an extension 15*d*. In this case, the restoring spring 7 is hooked between the two extensions 15*d* and 4*d*. A second contact spring 18 is also secured to the armature 15 which interacts with cooperating contacts 19 and 20.

The advantages set forth with reference to FIG. 1 are also achieved in the relay of FIG. 3, namely, contact friction during the switching event and a favorable force path curve. An even steeper rise in the magnet force curve m derives with the two armatures 4 and 15 and the two working air gaps associated therewith. Simultaneously, a decrease in the effective force of the restoring spring 7 has an intensified influence for both armatures 4 and 15. In the embodiment of FIG. 3, there is also the advantage that the two armatures and their respective advantages are provided while requiring only one coil excitation and further provides the advantage that one stationary yoke is eliminated.

Figure 4:
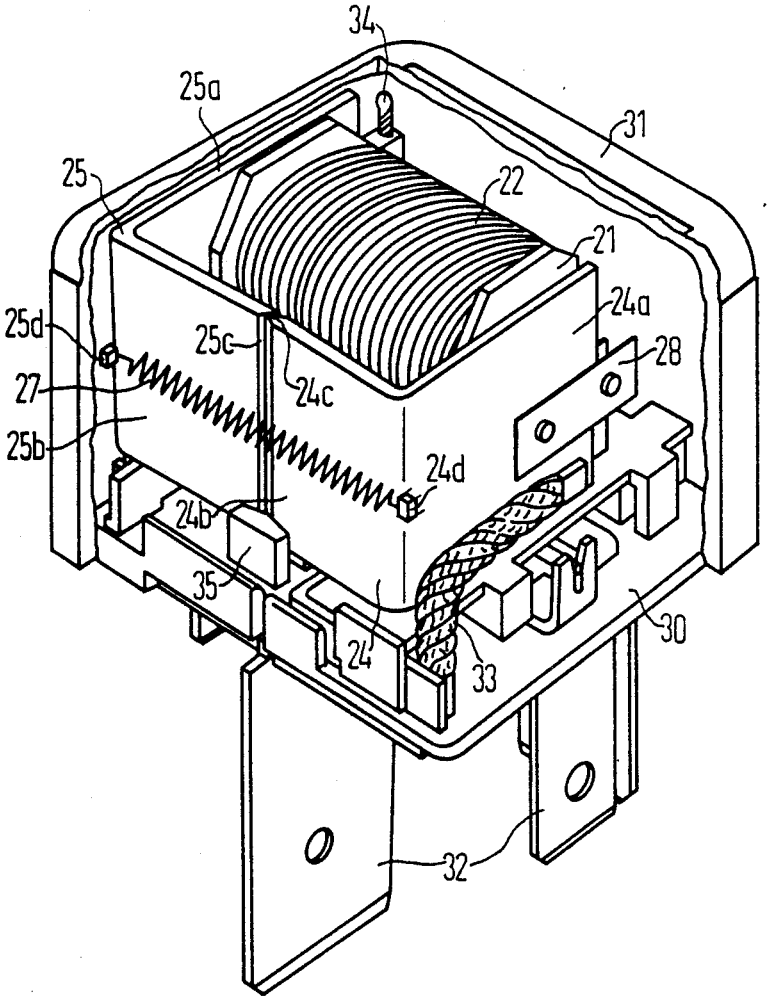
FIG. 4 is a perspective with portions of the housing cut away to show a more detailed structural development of the relay of FIG. 3.
Figure 5A:
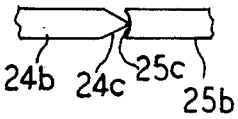
FIG. 5*a*, 5*b*, and 5*c* are enlarged schematic view of possible armature bearing constructions for the embodiment of FIGS. 3 and 4.
Figure 5B:
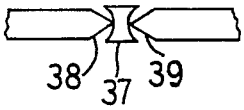
Figure 5C:
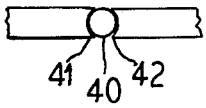

In the perspective view of FIG. 4 is shown a dual armature relay similar to that of FIG. 3 including further structural details. The relay includes a magnet system containing a coil member 21 having a winding 22, whereby the coil member 21 rests on a pedestal 23 for support. The relay system includes two armatures 24 and 25, each of which is angularly formed in accordance with the illustration of FIG. 3. First armature legs 24*a* and 25*a*, respectively, interact with a core (not shown). The first legs 24*a* and 25*a* also each carry a contact spring, such as the contact spring 28 on the first armature leg 24*a*. Second armature legs 24*b* and 25*b* extend next to the coil 22 and form inter-engaging bearing elements at their free ends. In the illustrated example of FIG. 4 and in FIG. 5*a*, the second armature leg 24*b* includes a bearing blade 25*c* while the leg 25*b* includes a cooperating bearing groove 25*c*. However, it is also conceivable, for instance, to equip both armatures 24 and 25 with a bearing blade or a bearing groove and to insert a corresponding intermediate element in between, for instance, in form of a rod having an X-shaped cross section, such as the rod 37 in FIG. 5*b* which cooperates with two bearing blades 38 and 39, or a rod 40 having a cylindrical cross section as shown in FIG. 5*c* which cooperates with armatures having bearing groovers 41 and 42, depending upon the design of the armature ends. A restoring spring 27 is hooked between extensions 24*d* and 25*d* for the two armatures. The two armatures function as set forth above with respect to FIG. 3.

As also may be seen in FIG. 4, the relay includes a pedestal 30 and a cap 31 (a portion of which is shown cut away) to form a housing. Terminal elements 32 in the form flat plugs, for example, are secured in the pedestal 30. The terminal elements 32 are connected to corresponding parts in the relay in a suitable, known fashion. For example, the contact springs 28 are connected via a stranded conductor 33 to coil terminals 34 via correspondingly bent connecting members 36. Supporting elements 35 (only the supporting element on the pedestal being visible) for both armatures are also supplied on the pedestal 30 and on the cap 31. As a result, the armatures which are otherwise only spring biased relative to one another are secured against lateral movement. Finally, it is to be understood that the contact spring may be formed in accordance with that disclosed in German GM No. 83 25 986 or European published application No. 0 136 592 instead of the extension of the yoke leg or armature for attaching the restoring spring. In this case, the variable lever arm is formed by the contact spring and not directly by the armature.

Although other modifications and changes may be suggested by those skilled in the art, it is the intention of the inventors to embody within the patent warranted hereon all changes and modifications as reasonably and properly come within the scope of their contribution to the art.

I claim:

1. An electromagnetic relay, comprising:
a coil having a coil axis;
a core axially arranged in said coil;
a first yoke being an L-shaped armature, said first yoke having;
a first leg defining a working air gap relative to a first end of said core,
a second leg of said L-shaped first yoke lying substantially parallel to said coil axis,
an extension of said first leg extending beyond said second leg;
a contact spring coupled to said first leg of said first yoke;
a second yoke being of an L-shape, said second yoke having:
a first leg facing toward a second end of said core,
a second leg of said second yoke extending substantially parallel to said coil axis adjacent said coil, said second leg of said second yoke having a free end nest to said coil at which a free end of said second leg of said first yoke is seated next to said coil,
an extension of said second yoke;
a tension restoring spring acting upon said extensions of said first and second yokes, said tension restoring spring lying substantially parallel to said coil axis,
said second yoke being a second armature having said first leg defining a working air gap relative to said core, free ends of both second legs of said first and second yokes being seated relatively movable to one another, and
said first and second yokes having inter-engaging bearing elements.

2. An electromagnetic relay, comprising:
a coil having a coil axis;
a coil axially arranged in said coil;
a first yoke being an L-shaped armature, said first yoke having:
a first leg defining a working air gap relative to a first end of said core,
a second leg of said L-shaped first yoke lying substantially parallel to said coil axis,
an extension of said first leg extending beyond said second leg;
a contact spring coupled to said first leg of said first yoke;
a second yoke being of an L-shape, said second yoke having:
a first leg facing toward a second end of said core,
a second leg of said second yoke extending substantially parallel to said coil axis adjacent said coil, said second leg of said second yoke having a free end next to said coil at which a free end of said second leg of said first yoke is seated,
an extension of said second yoke;
a tension restoring spring acting upon said extensions of said first and second yokes, said tension restoring spring lying substantially parallel to said coil axis,
said second yoke being a second armature having said first leg defining a working air gap relative to said core, free ends of both second legs of said first and second yokes being seated relatively movable to one another, and
a common inserted bearing element at which said first and second yokes are each seated.

3. An electromagnetic relay, comprising:
a coil having a coil axis;
a core axially arranged in said coil;
a first yoke being an L-shaped armature, said first yoke having:
a first leg defining a working air gap relative to a first end of said core,
a second leg of said L-shaped first yoke lying substantially parallel to said coil axis and having a free and forming a bearing end,
an extension of said first leg extending beyond said second leg;
a contact spring coupled to said first leg of said first yoke;
a second yoke being of an L-shaped armature, said second yoke having:
a first leg defining a second working air gap relative to a second end of said core,
a second leg of said second yoke extending substantially parallel to said coil axis adjacent said coil, said second leg of said second yoke having a free end forming a bearing end adjacent said bearing end of said second leg of said first yoke,
an extension of said first leg of said second yoke;
a tension restoring spring acting upon said extensions of said first and second yokes, said tension restoring spring lying substantially parallel to said coil axis;
said second legs of said first and second yokes each extending approximately half the length of said coil;
a housing encasing said relay; and
bearing supporting elements in said housing in a region of said bearing ends of said first and second yokes to guide said yokes.

4. An electromagnetic relay as claimed in claim 1, further comprising:
a housing about said relay; and
supporting elements in said housing extending into contact with said second legs of said first and second yokes to guide said first and second yokes within said housing.

5. An electromagnetic relay as claimed in claim 2, further comprising:
a housing about said relay; and
supporting elements in said housing extending into contact with said second legs of said first and second yokes to support said first and second yokes within said housing.

* * * * *